US007406721B2

(12) United States Patent
Husbands et al.

(10) Patent No.: US 7,406,721 B2
(45) Date of Patent: Aug. 5, 2008

(54) PROTECTION ATTACHMENT FOR A SAFETY HELMET

(76) Inventors: Simon Malcolm Husbands, 10 Fox Close, Brinsmead Glen, Cairns, Queensland 4870 (AU); Sergio Manuel Sequiera, 43 Summerhill Drive, Kanimbla, Cairns, Queensland 4870 (AU); Peter Graham Williams, 43 Summerhill Drive, Kanimbla, Cairns, Queensland 4870 (AU)

( * ) Notice: Subject to any disclaimer, the term of this patent is extended or adjusted under 35 U.S.C. 154(b) by 209 days.

(21) Appl. No.: 11/377,093

(22) Filed: Mar. 16, 2006

(65) Prior Publication Data

US 2006/0230496 A1 Oct. 19, 2006

(51) Int. Cl.
*A42B 1/06* (2006.01)

(52) U.S. Cl. ..... 2/172

(58) Field of Classification Search ..... 2/175.1, 2/175.6, 172, 175.3, 209.13, 195.1, 171
See application file for complete search history.

(56) References Cited

U.S. PATENT DOCUMENTS

| | | | | |
|---|---|---|---|---|
| 2,416,062 | A * | 2/1947 | Mercer | 2/175.5 |
| 4,993,081 | A * | 2/1991 | Fulghum | 2/209.12 |
| 5,333,328 | A | 8/1994 | Roberts | |
| 5,493,734 | A | 2/1996 | Nieves-Rivera | |
| 5,603,120 | A | 2/1997 | Gifford | |
| 5,701,609 | A | 12/1997 | Bridges | |
| 5,727,250 | A | 3/1998 | Black | |
| 5,862,520 | A * | 1/1999 | Wyant | 2/10 |
| 5,950,241 | A * | 9/1999 | Gomez | 2/172 |
| 6,170,084 | B1 | 1/2001 | Gordon et al. | |
| 6,237,162 | B1 | 5/2001 | Gill | |
| 6,260,204 | B1 * | 7/2001 | Morrissey | 2/172 |
| 6,374,421 | B1 * | 4/2002 | Cleary | 2/254 |
| 2002/0004946 | A1 | 1/2002 | Nelson | |

FOREIGN PATENT DOCUMENTS

| | | |
|---|---|---|
| AU | A-12437/97 | 8/1997 |
| CA | 2099470 | 12/1994 |
| DE | 29920140 U1 | 3/2000 |
| JP | 2000345422 A | 12/2000 |
| WO | WO/91/02468 | 3/1997 |

* cited by examiner

*Primary Examiner*—Danny Worrell
(74) *Attorney, Agent, or Firm*—B. Craig Killough

(57) ABSTRACT

A safety construction helmet is provided with an attachment which extends over the top of the helmet and provides sun protection.

11 Claims, 5 Drawing Sheets

PROTECTION ATTACHMENT FOR A SAFETY HELMET

PRIORITY CLAIM

Applicant hereby claims the benefit of priority of earlier filed PCT patent application Ser. No. PCT/2004/000660; filed May. 19, 2004, which claims the benefit of priority to Australian Patent Application Serial No. 2003248016, filed Sep. 18, 2003.

FIELD OF THE INVENTION

This invention is directed to an attachment which can be attached to a safety helmet (also known as a hard hat) and very commonly used in the construction industry. The attachment finds particular use to provide sun protection to the wearer of the safety helmet.

BACKGROUND ART

The wearing of a safety helmet is becoming mandatory in many construction industries. For instance, it is now mandatory to wear a safety helmet anywhere on site during construction of a high-rise building. Safety helmets are widely used throughout the industry and not just the construction industry. For instance, safety helmets are mandatory in many areas of the mining industry.

While there are various types of safety helmets, the helmets are typically manufactured from a hard plastic material. The inside portion of the helmet is provided with webbing straps which extend over the head of the user. At the rear of the helmet is an adjustment strap to allow the helmet to be properly fitted to the user.

With reference to the construction industry, the person wearing the safety helmet is often outside. During the hot summer months, the person can experience quite severe sunburn especially around the neck and face area. During rain, the current construction of the safety helmet does not particularly shield the person's face from rain.

It is well-known to provide some form of neck cloth or neck protecting member to protect against the sun. Sometimes, these cloths are attached to the helmet and this can be achieved using tape, elastic and the like. While this provides some relief from sunburn on the person's neck, the cloths are not suitable to protect the person's face.

It is also not advantageous (and may even be illegal) to modify the standard safety helmet by riveting or otherwise attaching lateral members to provide some relief from the sun. Also, it may be necessary to ensure that any such attachment has some form of release mechanism should the attachment become caught in machinery etc.

Therefore, there would be an advantage if it were possible to purchase an attachment for a safety helmet that does not require modification of the helmet itself which can be quite easily removed if not required or if caught by machinery, and which can provide sun protection.

It will be clearly understood that, if a prior art publication is referred to herein, this reference does not constitute an admission that the publication forms part of the common general knowledge in the art in Australia or in any other country.

OBJECT OF THE INVENTION

It is an object of the invention to provide an attachment for a safety helmet that may overcome at least some of the above-mentioned disadvantages or provide the consumer with a useful or commercial choice.

In one form, the invention resides in an attachment attachable to a safety helmet, the attachment comprising a first attachment means attachable to a first part of the helmet, and a second attachment means attachable to a second part of the helmet, the first part and the second part being spaced apart, the attachment comprising a laterally extending member to provide sun protection to a person wearing the helmet.

The attachment can be quickly attached to the helmet and typically in such a manner that it is not easily removed and therefore will not inadvertently fall of the helmet, but which does not require any modification of the helmet design.

The first attachment means is typically attached to a front part of the helmet and therefore the first attachment means can be seen as a front attachment means. The second attachment means is typically attached to a rear part of the helmet and therefore the second attachment means can be seen as a rear attachment means. The attachment may have a further attachment means although it seems that the first and second attachment means is sufficient to secure the attachment to the helmet.

The attachment includes a laterally extending member to provide sun protection. The laterally extending member typically comprises a relatively wide brim that extends at least partially and preferably fully around the helmet. The brim typically extends past the normal edge of the helmet by a distance sufficient to provide at least some sun protection. It is found that a brim having a width of between 5-20 centimeters is suitable.

It is preferred that the attachment is made of a resilient material as this can allow the laterally extending member to have resilience. Thus, the laterally extending member can bend without snapping or breaking and will resume its original laterally extending orientation afterwards. Various materials are envisaged for the manufacture of the attachment. It is envisaged that plastics or plastic containing materials will be particularly suitable especially to provide the resilient nature of the attachment. For instance, a polyalkylene plastic may be suitable. This may include a polyethylene or polypropylene plastic material.

The attachment may have a thickness of between 0.5-5 millimetres depending on the material of manufacture. It is also desirable that the attachment is not unnecessarily heavy. Therefore, a thickness of between 1-3 millimetres is particularly preferred and if the attachment is made of polypropylene, this may have a thickness of between 1-2 millimetres. However, no particular limitation is meant thereby.

The front attachment means may comprise at least one tongue member. The tongue member may be formed integrally with the attachment and in a particular embodiment, the tongue member can be formed by punching the tongue member out of the brim. However, the front attachment means may also be formed separately and attached to the brim or other part of the device. The tongue member may be curved.

The rear attachment means may also comprise at least one tongue member and this can also be formed by punching the tongue member out of the brim or by providing a separate tongue member which is attached to the brim. The rear tongue member is typically wider than the front tongue member. The design of the rear tongue member is suitably such that a linkage strip is formed between the tongue member and the inner edge of the brim, to prevent the entire attachment from collapsing over the head of the wearer.

It is preferred that the attachment comprises a neck protector. The neck protector may comprise a sun flap that can be attached to the attachment by any suitable means. It is preferred that the neck protector can be ripped away from the remainder of the attachment should the neck protector become caught in machinery etc. Various ways to achieve this are envisaged and one way is to attach the neck protector to the remainder of the attachment by a VELCRO type fastening system. However, press studs may also be used and it is envisaged that the neck flap may also be provided with a portion or line of weakness to provide a preferential tear line.

BRIEF DESCRIPTION OF THE DRAWINGS

An embodiment of the invention will be described with reference to the following drawings in which.

BEST MODE

Figure 1:
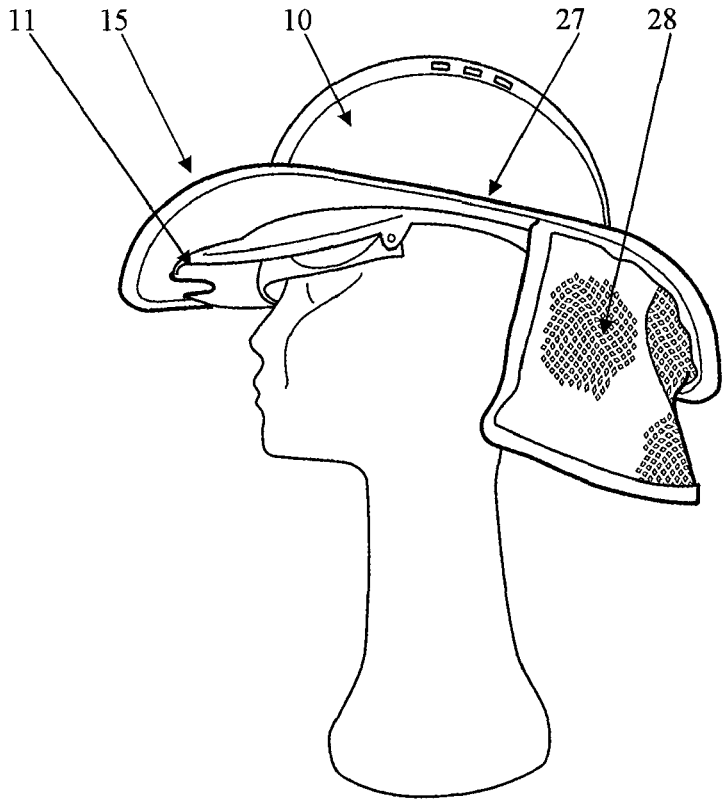
FIG. 1. Illustrates a safety helmet containing the attachment and in side view.
Figure 2:
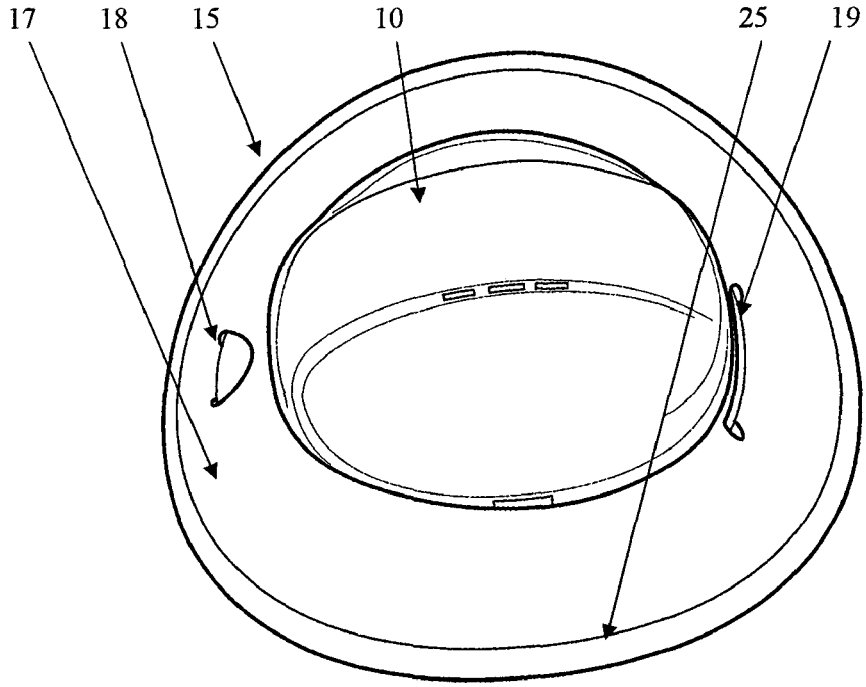
FIG. 2. Illustrates a plan view of the safety helmet containing the attachment.
Figure 3:
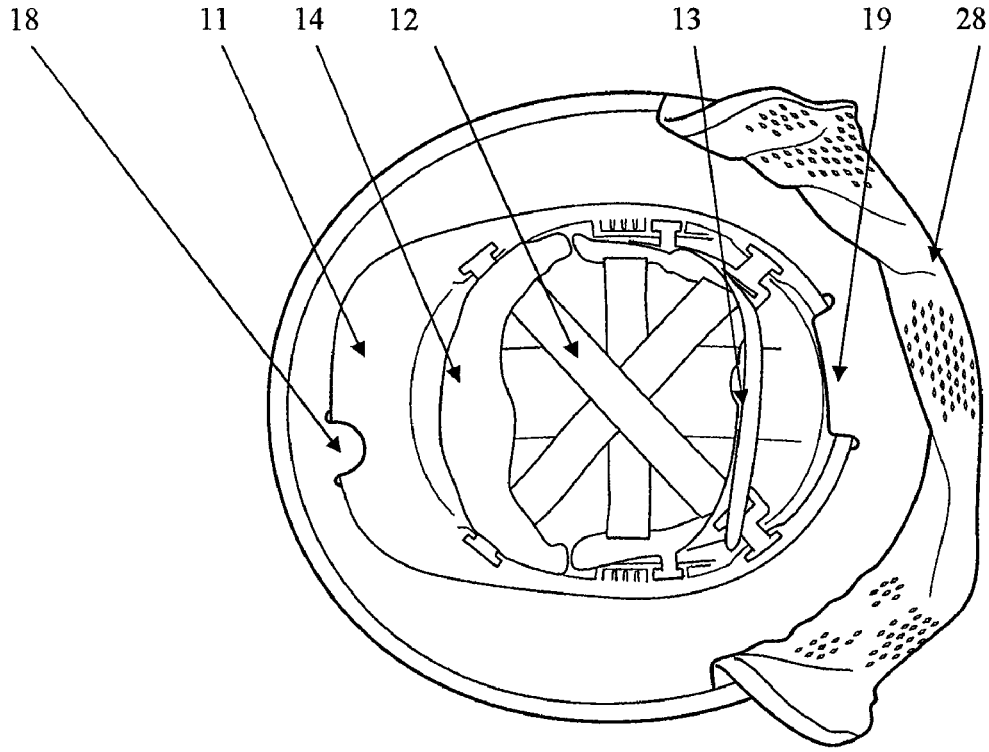
FIG. 3. Illustrates an inside view of the safety helmet containing the attachment.

Referring to the illustrations, and initially to FIGS. 1-3 there is illustrated a conventional safety helmet 10. Helmet 10 is formed of hard plastic material and contains a front peak 11. Around the helmet is a small channel shaped recess (not illustrated) the function of which is to provide rigidity to the helmet. Inside the helmet (see FIG. 3) are webbing straps 12, a rear adjustment means 13 and an absorbent and cushioning strip 14 which extends about the brow of the wearer. This arrangement is entirely conventional. A disadvantage with this type of conventional safety helmet is that it provides little or no sun protection to a person's neck and face.

Figure 4:
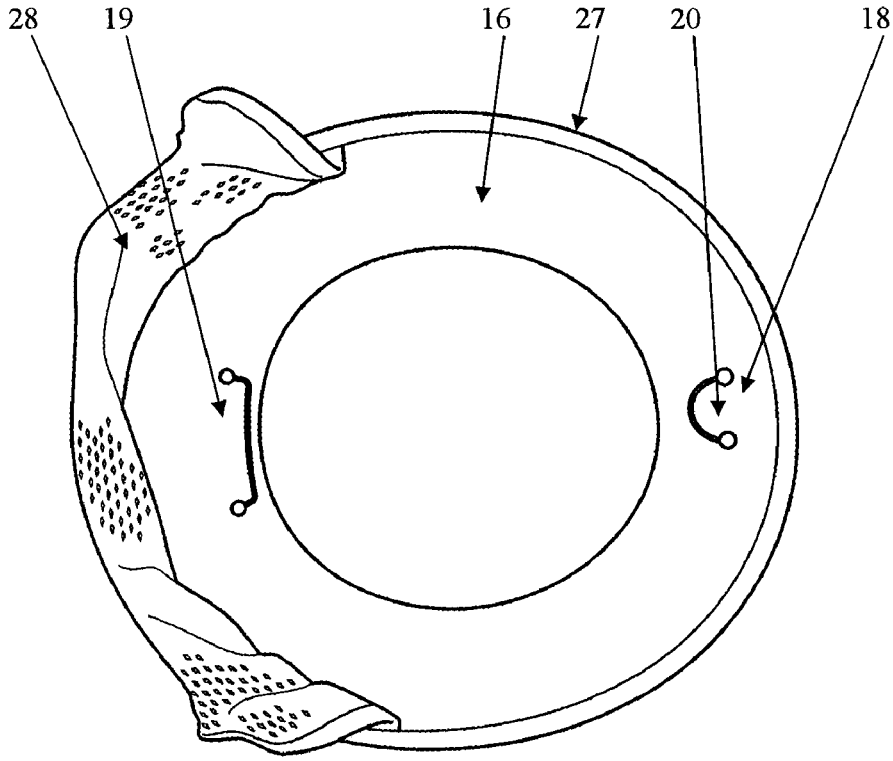
FIG. 4. Illustrates an inverted plan view of the attachment by itself.
Figure 5:
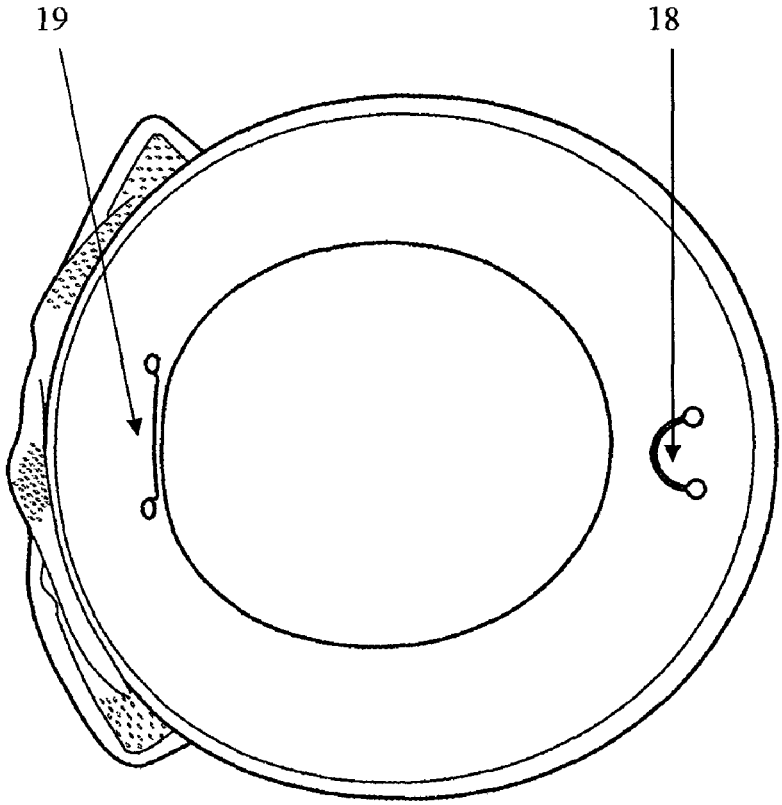
FIG. 5. Illustrates a plan view of the attachment by itself.

Attached to safety helmet 10 is a sun and protecting attachment 15 which forms part of the present invention. The attachment per se is illustrated in FIGS. 4 and 5 and the attachment on the safety helmet is illustrated in FIGS. 1-3.

Attachment 15 basically comprises a slightly oval annular member which is made of resilient material. In the particular embodiment, the member is made of polypropylene plastic having a thickness of about 1.4 millimetres. The attachment is substantially white in color but the underside 16 (see figure four) is embossed to prevent glare. The attachment has a laterally extending brim portion 17 which extends entirely about helmet 10 (see FIG. 2). The brim portion has a width of 80 millimetres but this can of course vary.

Figure 6:
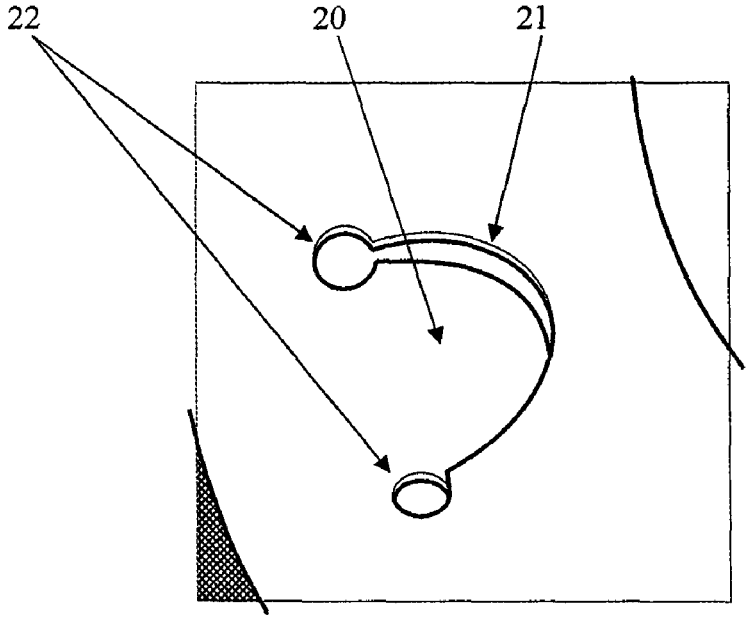
FIG. 6. Illustrates a close-up view of the front attachment means.
Figure 8:
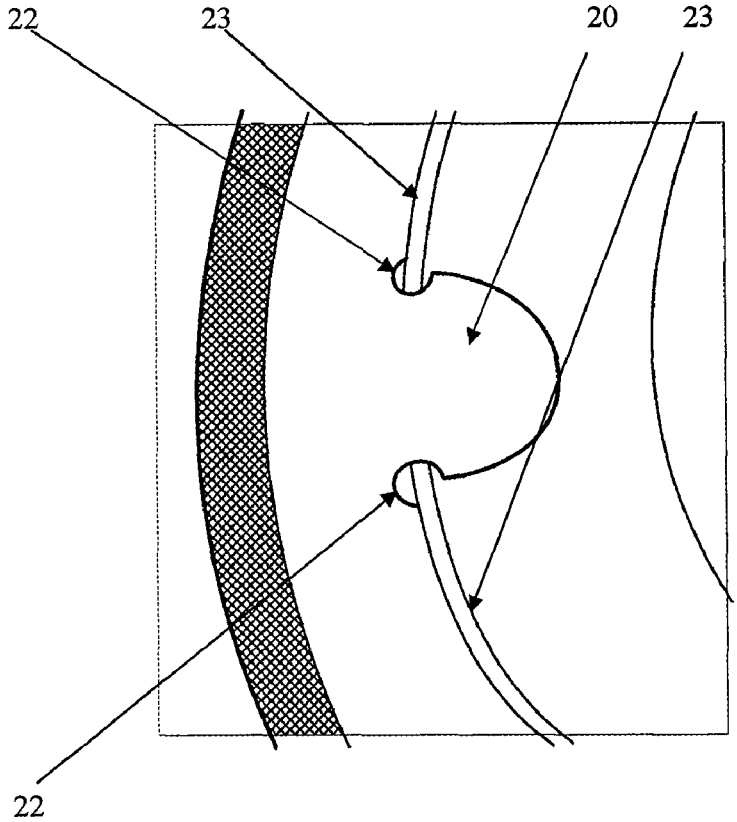
FIG. 8. Illustrates the front attachment means attached to the front of the helmet.

Attachment 15 is attached to helmet 10 using a first attachment means and a second attachment means. In the particular embodiment, the first attachment means comprises a front attachment means 18 and the second attachment means comprises a rear attachment means 19. These are illustrated in FIGS. 2 and 4 at least. The front attachment means 18 is punched out of brim portion 17 and comprises a tongue member 20 which is illustrated in FIG. 4 and FIG. 6. Tongue member 20 is defined by a curved cut 21 (see FIG. 6) through brim portion 17 which terminates in a pair of circular openings 22. The function of openings 22 is to extend about the front edge of peak 11 with the edge 23 of the peak extending through openings 22. This is best illustrated in FIG. 8.

Figure 7:
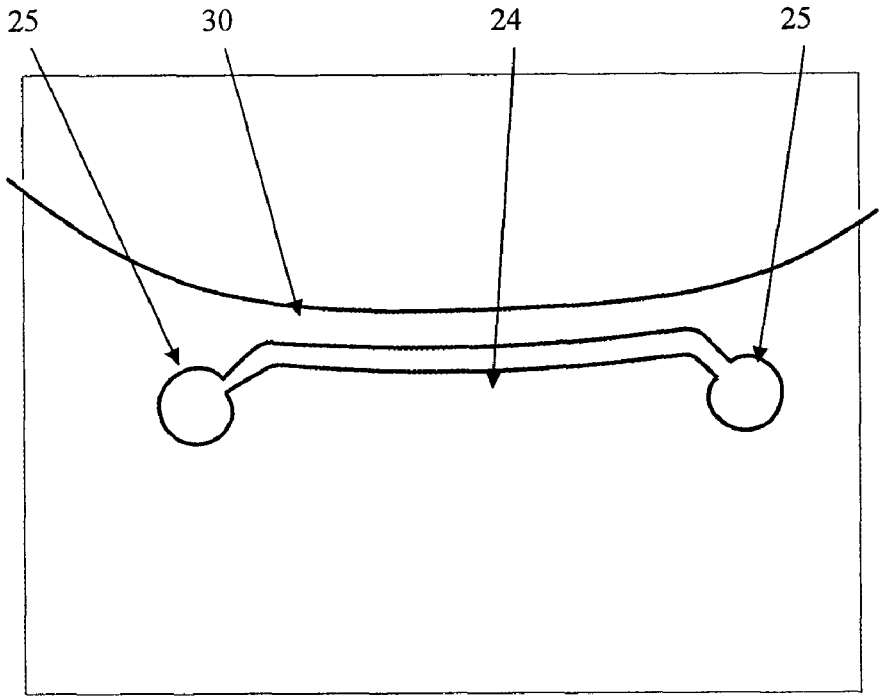
FIG. 7. Illustrates a close-up view of the rear attachment means.
Figure 9:
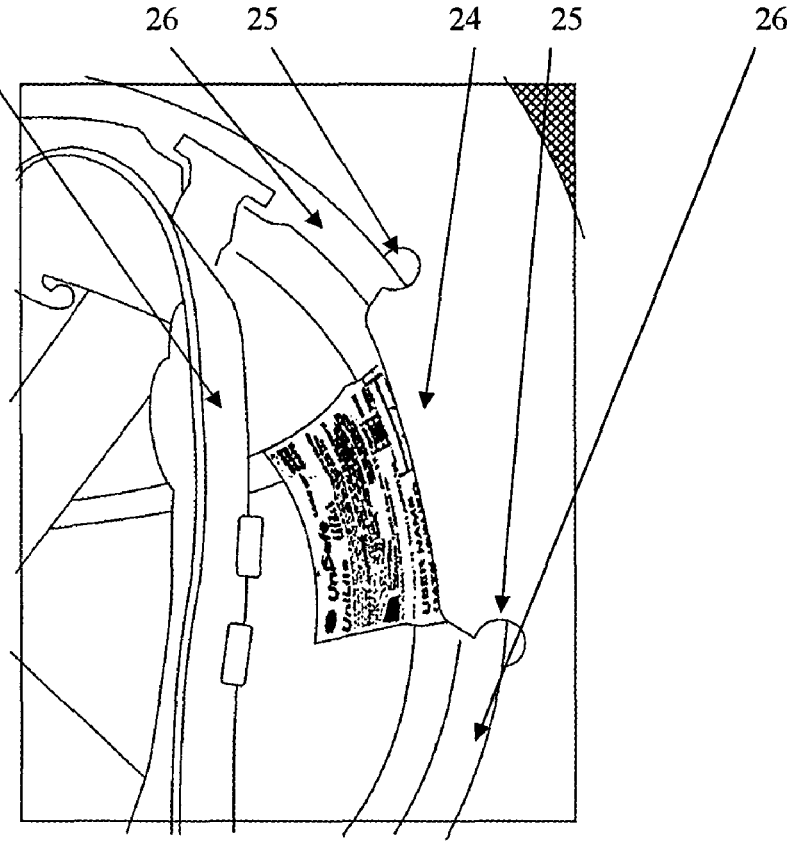
FIG. 9. Illustrates an internal view of the rear attachment means attached to the rear of the helmet.
Figure 10:
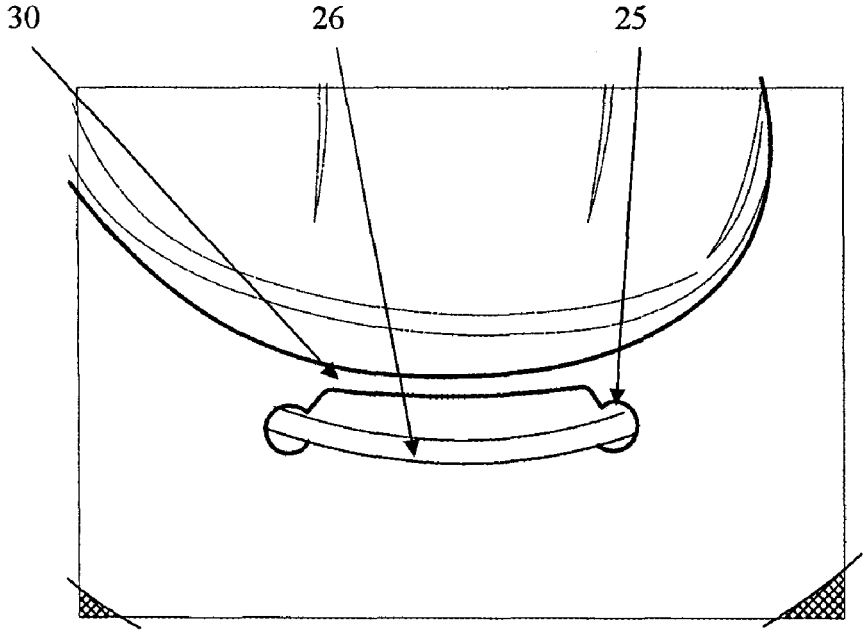
FIG. 10. Illustrates an external view of the rear attachment means attached to the rear of the helmet.

The rear attachment means 19 is best illustrated in FIG. 7, FIG. 9 and FIG. 10. The rear attachment means also comprises a tongue member 24 (see FIG. 7 and FIG. 9) but this tongue member is much wider than the front tongue member 20. Again, the tongue member is formed by cutting through brim portion 17 and again a pair of openings 25 (see FIG. 7) extends on each side of tongue member 24. The function of these openings is similar to that of the front tongue member and allows the peripheral edge 26 (see FIG. 9) of helmet 10 to pass through these openings.

A material binding 27 extends about the periphery of attachment 15 for extra safety and to soften the outer edge of attachment 15. The material binding also provides a mechanism to allow a neck cloth 28 (see FIG. 1) to be releasably attached to attachment 15. In the particular embodiment, the mechanism comprises a Velcro strip attached to neck cloth 28 and a second Velcro strip attached to the underside of material binding 27 to allow the neck cloth 28 to be attached to attachment 15 in a removable manner. The neck cloth is fully washable for hygiene purposes.

The openings 22 and 25 in the front tongue member and the rear tongue member also function to prevent the flaps from ripping during normal use of the product. The rear tongue and 24 is shaped to secure in place under the back of the helmet while still providing the necessary clearance from the head supporting webbing.

The rear tongue member 24 is also cut to provide a small linkage strip 13 (see FIG. 7 and FIG. 10) which is designed to prevent the attachment from collapsing over the head of the wearer and also helps to provide the optimum shape for shading from the sun.

The annular shape of attachment 15 is such that the "hole" in the middle is large enough to enable the attachment to be placed over most models of safety helmet on the market.

The attachment provides good sun protection to wearers of the safety helmet. If not required, the attachment can be easily removed with no damage to the helmet. There is no need to modify the helmet and in particular there is no need to drill holes through the helmet, glue or rivet attachments to the helmet etc. By being made of plastics material, the attachment is robust and resilient and can also provide rain protection and even better protection against small objects falling on the safety helmet.

Throughout the specification and the claims (if present), unless the context requires otherwise, the term "comprise", or variations such as "comprises" or "comprising", will be understood to apply the inclusion of the stated integer or group of integers but not the exclusion of any other integer or group of integers.

It should be appreciated that various other changes and modifications can be made to any embodiment described without departing from the spirit and scope of the invention. For instance, while the invention has been described with reference to a safety helmet, the attachment maybe used in relation to other types of headwear where sun protection is desirable.

The invention claimed is:

1. An attachment for a safety helmet having a brim portion, the attachment comprising an annular outwardly extending brim with a substantially central opening defined by a seating edge which extends entirely about the safety helmet, a first attachment tongue member extending generally in the plane of the brim from the seating edge of the opening inwardly into the central opening and which is attachable to a brim portion at a front part of the helmet, and a second attachment means tongue member extending generally in the plane of the brim from the seating edge of the opening inwardly into the central opening and which is attachable to a rear lower rim portion of the helmet, the first attachment means and the second attachment means whereby each tongue member attaches the attachment to the safety helmet.

2. The attachment as claimed in claim 1, wherein the brim has a width of between 5-20 centimeters.

3. The attachment as claimed in claim 1, wherein the attachment is made of a resilient material.

4. The attachment as claimed in claim 3, wherein the attachment is made of plastics.

5. The attachment as claimed in claim 4, wherein the attachment is made of polypropylene.

6. The attachment as claimed in claim 5, wherein the attachment has a thickness of between 1-2 millimeters.

7. The attachment as claimed in claim 1, wherein at least one of the tongue members is punched out of the brim.

8. The attachment as claimed in claim 7, wherein the second attachment means includes a linkage strip between the second attachment means and an inner edge of the brim.

9. The attachment as claimed in claim 1, including a neck protector.

10. The attachment as claimed in claim 9, wherein the neck protector is releasably attached to the brim.

11. An attachment according to claim 1 wherein the brim of the attachment is continuous.

* * * * *